US008295441B2

(12) United States Patent
Beyerlein et al.

(10) Patent No.: US 8,295,441 B2
(45) Date of Patent: Oct. 23, 2012

(54) MULTICATHODE X-RAY TUBE

(75) Inventors: Walter Beyerlein, Bubenreuth (DE); Andreas Böhme, Nürnberg (DE); Markus Hemmerlein, Neunkirchen/Br (DE); Oliver Heuermann, Hemhofen (DE); Jürgen Oelschlegel, Nürnberg (DE); Peter Wehrle, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 424 days.

(21) Appl. No.: 12/711,802

(22) Filed: Feb. 24, 2010

(65) Prior Publication Data

US 2010/0226479 A1 Sep. 9, 2010

(30) Foreign Application Priority Data

Mar. 4, 2009 (DE) ..... 10 2009 011 642

(51) Int. Cl.

| | |
|---|---|
| ***H01J 35/06*** | (2006.01) |
| ***H01J 35/04*** | (2006.01) |
| ***H05G 1/56*** | (2006.01) |
| ***H05G 1/08*** | (2006.01) |

(52) U.S. Cl. ..... 378/134; 378/92; 378/114

(58) Field of Classification Search ..... 378/91, 378/92, 101, 109–112, 114, 119, 121, 134, 378/136, 204, 210

See application file for complete search history.

(56) References Cited

U.S. PATENT DOCUMENTS 7,295,651 B2 11/2007 Delgado et al.

FOREIGN PATENT DOCUMENTS

| | | |
|---|---|---|
| DE | 10246548 | 4/2004 |
| DE | 102005052131 | 5/2007 |
| DE | 102007041829 | 3/2009 |
| JP | 59040449 A | 3/1984 |

OTHER PUBLICATIONS

German Office Action dated Sep. 16, 2009 with English translation.

Lanza, Gregory M. et al., "Novel Paramagnetic Contrast Agents for Molecular Imaging and Targeted Drug Delivery," Current Pharmaceutical Biotechnology, vol. 5, No. 6, 2004, pp. 495-507.

Zhang, J. et al., "Stationary scanning x-ray source based on carbon nanotube field emitters," Applied Physics Letters 86, 184104, 2005, 3 pages.

*Primary Examiner* — Anastasia Midkiff

(74) *Attorney, Agent, or Firm* — Lempia Summerfield Katz LLC

(57) ABSTRACT

An improved x-ray tube that includes a plurality of cathodes in a region under vacuum is provided. Several wirelessly activatable elements, which are each assigned to a cathode or a group of cathodes, are arranged in the region under vacuum and make an electrically conducting connection of the cathode or the group of cathodes to a cathode control voltage line when receiving a control signal from outside of the region under vacuum. A system that includes the improved x-ray tube and several transmitter elements for the wireless activation of the wirelessly activatable elements is also provided.

20 Claims, 4 Drawing Sheets

MULTICATHODE X-RAY TUBE

The present patent document claims the benefit of DE 10 2009 011 642.7, filed Mar. 4, 2009, which is hereby incorporated by reference.

BACKGROUND

The present embodiments relate to an improved x-ray tube with several cathodes.

It is known in the prior art to replace conventional thermal cathodes in x-ray tubes with carbon nanotubes (CNT). CNTs can be embodied in such a way that the CNTs emit electrons by field emission and serve as efficient electron emitters for flat and self-luminous field emission displays or as cathodes in x-ray tubes.

In one known embodiment of an x-ray tube, several CNT cathodes are arranged in a tube (see Zhang, J., et al., "Stationary scanning x-ray source based on carbon nanotube field emitters." Appl. Phys. Lett. 86, 18104 (2005)). Such a multicathode tube allows a spatial resolution, which can only be achieved with conventional single cathode tubes by mechanical displacement of the x-ray tube.

In the field of computed tomography (CT), it is desirable to integrate a large number of cathodes (e.g., 1000) in a tube. It is disadvantageous that for each cathode, which is arranged in the region of the tube under vacuum, a feedthrough toward the outside to a control unit is provided. The feedthroughs are problematic because the feedthroughs have a high withstand voltage. Typical voltages that occur amount to between 0 and 5 kV.

SUMMARY AND DESCRIPTION

The present embodiments may obviate one or more of the drawbacks or limitations inherent in the related art. For example, in one embodiment, an x-ray tube with a plurality of cathodes, including fewer vacuum feedthroughs for the control lines of the cathodes than the number of cathodes, may be provided.

In one embodiment, an x-ray tube includes a region under vacuum, several cathodes arranged in the region under vacuum, and several wirelessly activatable elements arranged in the region under vacuum. The several wirelessly activatable elements are each assigned to a cathode or a group of cathodes, and each of the several wirelessly activatable elements makes an electrically conducting connection of the corresponding cathode or group of cathodes to a cathode control voltage line, when each of the several wirelessly activatable elements receives a control signal from outside of the region under vacuum.

The several wirelessly activatable elements may be activated optically. For example, light-controllable semi-conductors (e.g., light-triggerable thyristors or transistors) may be used as wirelessly activatable elements.

Alternatively, the several wirelessly activatable elements may be activated using an electric and/or a magnetic field. For example, pulse transformers, elements using the GMR effect, or Hall elements may be used as the several wirelessly activatable elements.

The number of vacuum feedthroughs for the cathode control voltage lines may therefore be reduced. Power may be fed to the several cathodes by a single or a few cathode control voltage lines. In one embodiment, the several cathodes are connected in a non-activated state of the several wirelessly activatable elements with no voltage, and to the single or the few cathode control voltage lines when the several wirelessly activatable elements are correspondingly activated.

In one embodiment, a system includes the x-ray tube described above, several transmitter elements for the wireless activation of the several wirelessly activatable elements, and a control unit for controlling the several transmitter elements.

In one embodiment, the several transmitter elements and the several wirelessly activatable elements may he configured such that the several wirelessly activatable elements act as on/off switches (e.g., in response to the control signals, the several wirelessly activatable elements make or break the electrically conductive connections of the cathodes or the groups of cathodes to the cathode control voltage line(s)). Accordingly, the intensity (effective) of the current flowing through the electrically conducting connections may be controlled using modulated control signals.

In one embodiment, the several transmitter elements and the several wirelessly activatable elements may be configured such that the control signals influence the resistance of the electrically conductive connections of the cathodes or the groups of cathodes to the cathode control voltage line(s) and thus control the intensity of the current flowing through the electrically conducting connections.

In one embodiment of the system, a measurement device may be provided for measuring the current flowing through the cathode control voltage line(s). With the measurement device, a control unit with a calibration mode may be implemented, in which: a defined control signal is emitted; an assigned cathode current measurement value is detected; the defined control signal is modified until a defined cathode current measurement value is achieved; the modified control signal for the defined cathode current measurement value is stored; and the process is repeated until corresponding control signals have been determined for all the cathode current measurement values of interest.

Alternatively, or in addition, the control unit may have a learn mode, in which: a defined control signal is emitted; an assigned cathode current measurement value is detected; an assignment of the defined control signal to the assigned cathode current measurement value is stored; and the process is repeated until corresponding control signals are determined for all cathode current measurement values of interest.

DETAILED DESCRIPTION

Figure 1:
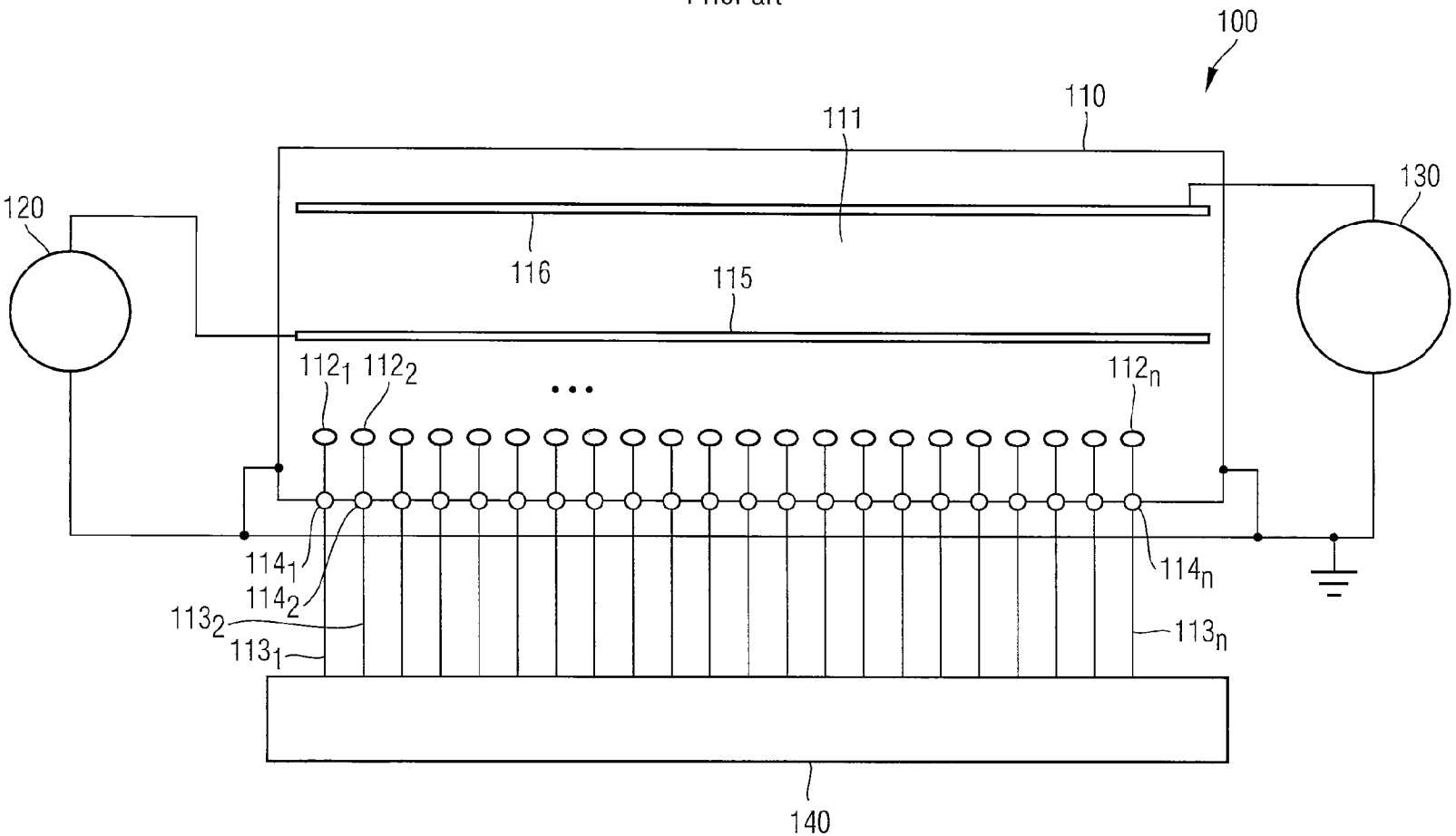
FIG 1 Prior art
FIG. 1 is a schematic view of a CNT x-ray tube according to the prior art.

In FIG. 1, an x-ray tube 110, known from the prior art, with a plurality n of CNT cathodes $\mathbf{112}_1 \ldots \mathbf{112}_n$ in a region under vacuum 111 is schematically shown. Each of the CNT cathodes $\mathbf{112}_1 \ldots \mathbf{112}_n$ is supplied by a separate cathode line $\mathbf{113}_1 \ldots \mathbf{113}_n$, which is fed into the region under vacuum 111 by a respective vacuum feedthrough $\mathbf{114}_1 \ldots \mathbf{114}_n$. A grid 115 and an anode 116 are arranged in the region under vacuum 111.

Additional components of a system 100, in which the x-ray tube 110 is embedded, are located outside of the region under vacuum 111. A grid voltage supply 120 is electrically connected to the grid 115, and an anode voltage supply 130 is electrically connected to the anode 116 and a control unit 140. Typical grid voltages are 5 kV, and typical anode voltages are between 20 kV and 180 kV.

Figure 2:
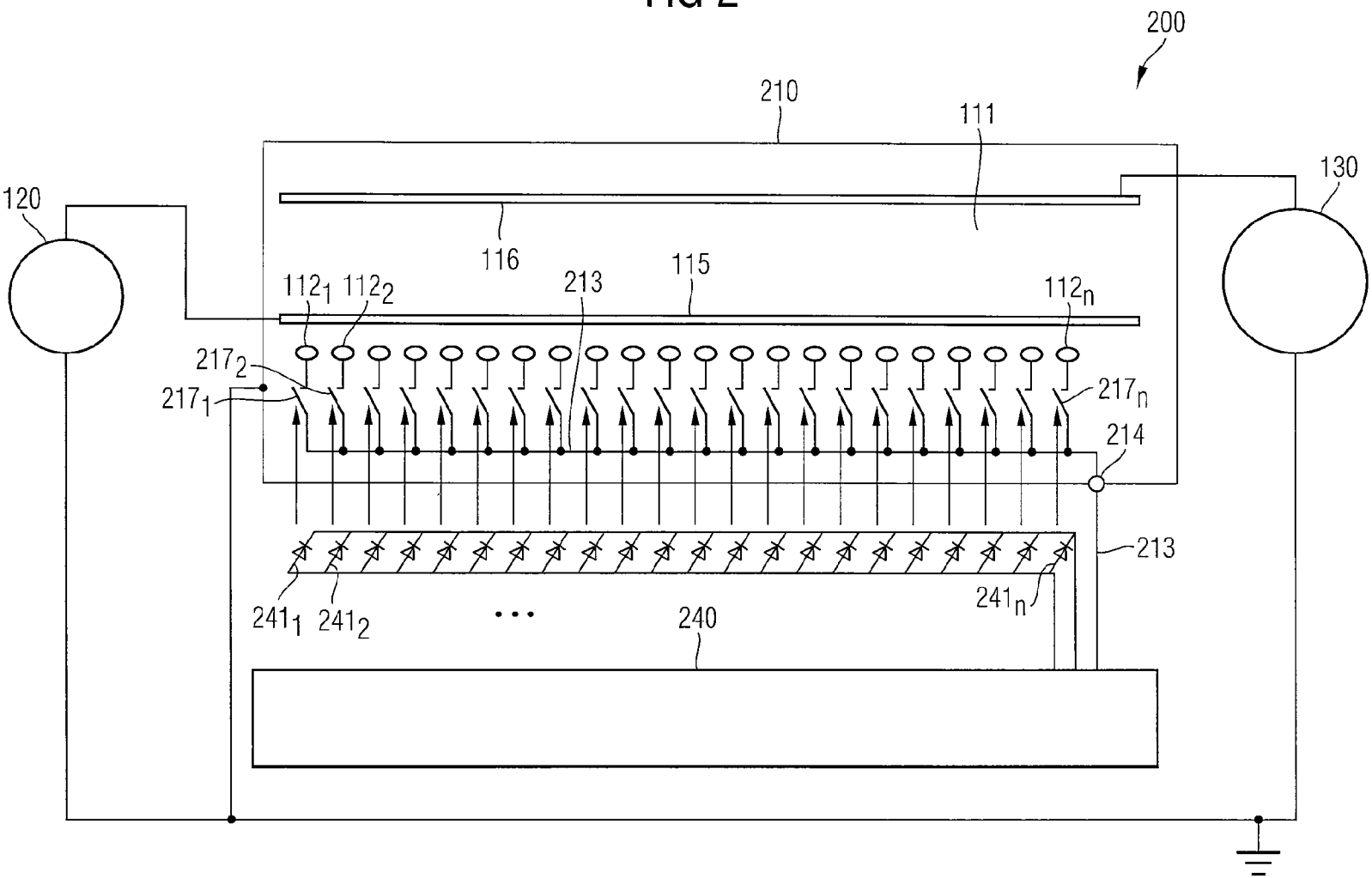
FIG. 2 is a schematic view of one embodiment of an x-ray tube.

FIG. 2 schematically shows one embodiment of an x-ray tube 210 integrated in a system 200. The x-ray tube 210 includes a region under vacuum 111, in which a number n of cathodes $\mathbf{112}_1 \ldots \mathbf{112}_n$ are arranged. A wirelessly activatable element $\mathbf{217}_1 \ldots \mathbf{217}_n$ is assigned to each cathode $\mathbf{112}_1 \ldots \mathbf{112}_n$. Each of the wirelessly activatable elements 217 may be a switching element, which, in the non-activated state, electrically disconnects the respectively assigned cathode 112 from a cathode voltage supply 213 common to the cathodes 112. In the activated state, each of the wirelessly activatable elements 217 electrically connects the respectively assigned cathode 112 to the cathode voltage supply 213.

FIG. 2 shows one embodiment of an x-ray tube 210 that includes optically activatable switching elements. A wireless transmitter element $\mathbf{241}_1 \ldots \mathbf{241}_n$, which is controlled by the control unit 240 and sends out an optical control signal (e.g., activation signal) using the control unit 240 during corresponding activation, is assigned to each of the n wirelessly activatable elements $\mathbf{217}_1 \ldots \mathbf{217}_n$. In one embodiment, only the assigned wirelessly activatable element 217 responds to the optical control signal sent by the wireless transmitter element 241 (e.g., represented by arrows in FIG. 2). A region of an x-ray tube housing, between the wirelessly activatable elements 217 arranged in the region under vacuum 111 and the wireless transmitter elements 241 arranged outside of the region under vacuum 111, is transparent for a respective wavelength (e.g., made of glass).

In order to avoid activation errors, neighboring wirelessly activatable elements may be activated with different wavelengths when the wirelessly activatable elements 217 are arranged tightly, so that a scattering activation signal of the neighboring wirelessly activatable elements has no effect. Alternatively or in addition, the activation signals may be conveyed from the wireless transmitter elements 241 to near the x-ray tube housing using light guides. In one embodiment, activation errors may be avoided by using focusing optics in an optical path between the wireless transmitter element 241 and the assigned wirelessly activatable element 217. In one embodiment, laser light sources may be used as the wireless transmitter elements 241. Visible or invisible light may be suitable for signal transmission.

Light-controllable semiconductors, for example, are optically activatable switching elements (e.g., light-triggerable thyristors or light-triggerable transistors). Special Silicon Carbide (SiC)-based thyristors/transistors achieve blocking voltages of, for example, 6 kV and may therefore be used as individual wirelessly activatable elements 217. Alternatively, semiconductor elements with lower withstand voltage may be arranged in series in order to achieve a total withstand voltage. In one embodiment, cascode or tandem connections, which are activated by photo diodes, may be used. The separate components together then form a wirelessly activatable element 217.

As shown in FIG. 2, in one embodiment, one vacuum feedthrough 214 is used in order to couple all cathodes 112 selectively with the cathode voltage supply. In the prior art, as shown in FIG. 1, one feedthrough $\mathbf{114}_1 \ldots \mathbf{114}_n$ is used for each cathode $\mathbf{112}_1 \ldots \mathbf{112}_n$. Manufacturing an x-ray tube according to the prior art is more difficult since the feedthroughs $\mathbf{114}_1 \ldots \mathbf{114}_n$ are airtight—one individual leaky feedthrough 114 (e.g., out of 1000) makes the whole x-ray tube unusable. Since generally one cathode 112 or a few cathodes 112 are supplied with voltage at the same time, the demands on the electrical load rating of the cathode voltage supply 213 are no higher or manageably higher than in the individual supply 113 according to the prior art shown in FIG. 1.

In one embodiment, provision may be made for activating two or more cathodes 112 by a common wirelessly activatable element 217. In one embodiment, provision may be made for a wireless transmitter element 241 to act at the same time on two or more wirelessly activatable elements 217 and thus control two or more cathodes at the same time. The two or more wirelessly activatable elements 217 may not be arranged next to each other but may be arranged as required. The activation signals may be optically distributed using light guides and guided to the two or more wirelessly activatable elements 217.

Figure 3:
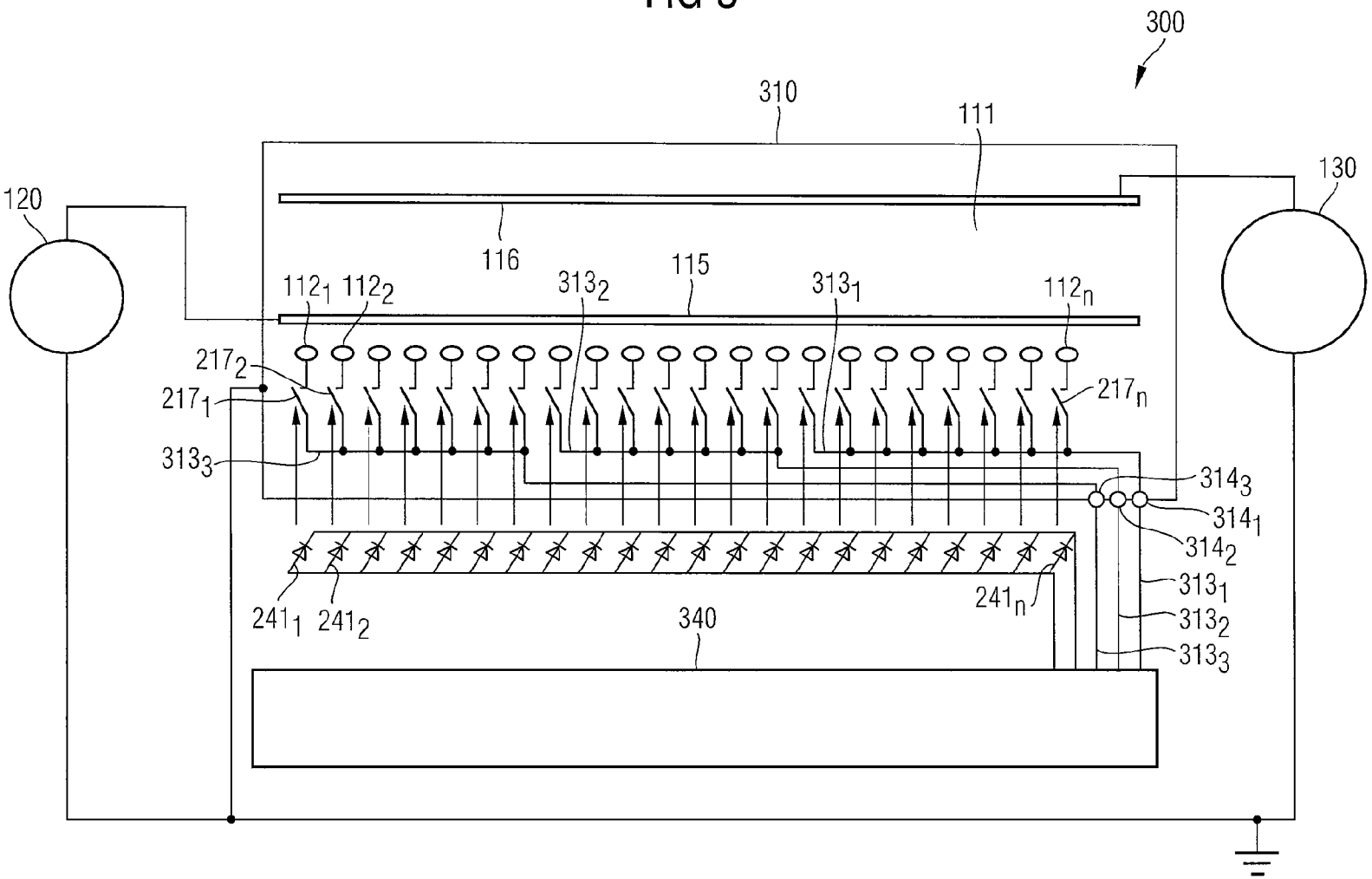
FIG. 3 is a schematic view of one embodiment of an x-ray tube integrated in one embodiment of a system.

FIG. 3 schematically shows one embodiment of an x-ray tube 310 integrated within a system 300. The x-ray tube 310 includes a region under vacuum 111, in which a number n of cathodes $\mathbf{112}_1 \ldots \mathbf{112}_n$ are arranged. Each cathode $\mathbf{112}_1 \ldots \mathbf{112}_n$ is assigned to a wirelessly activatable element $\mathbf{217}_1 \ldots \mathbf{217}_n$. In one embodiment, each of the wirelessly activatable elements 217 is a switching element, which in a non-activated state, electrically disconnects the respectively assigned cathode 112 from a cathode voltage supply 313, and in the activated state, electrically connects the respectively assigned cathode 112 to the cathode voltage supply 313.

With regard to the wirelessly activatable elements 217 and the assigned wireless transmitter elements $\mathbf{241}_1 \ldots \mathbf{241}_n$, the embodiment of FIG. 3 does not differ from the embodiment shown in FIG. 2. To avoid repetition, reference is made to the description of FIG. 2.

In contrast to the embodiment of the x-ray tube shown in FIG. 2, the embodiment illustrated in FIG. 3 includes a plurality of cathode voltage supplies $\mathbf{313}_1 \ldots \mathbf{313}_3$ (e.g., three). Each of the cathode voltage supplies 313 is assigned to a group of cathodes. Such an arrangement is advantageous if in the practical operation of the x-ray tube 310, several cathodes 217, which belong to several groups, are in operation at the same time, since then the electrical load of each of the cathode voltage supplies 313 may be limited. Although three vacuum feedthroughs $\mathbf{314}_1$, $\mathbf{314}_2$, $\mathbf{314}_3$ are shown in the example embodiment of FIG. 3, three is few in comparison with the prior art. In addition to activating the wireless transmitter elements 241, a control unit 340 may also selectively activate the cathode voltage supplies 313.

Figure 4:
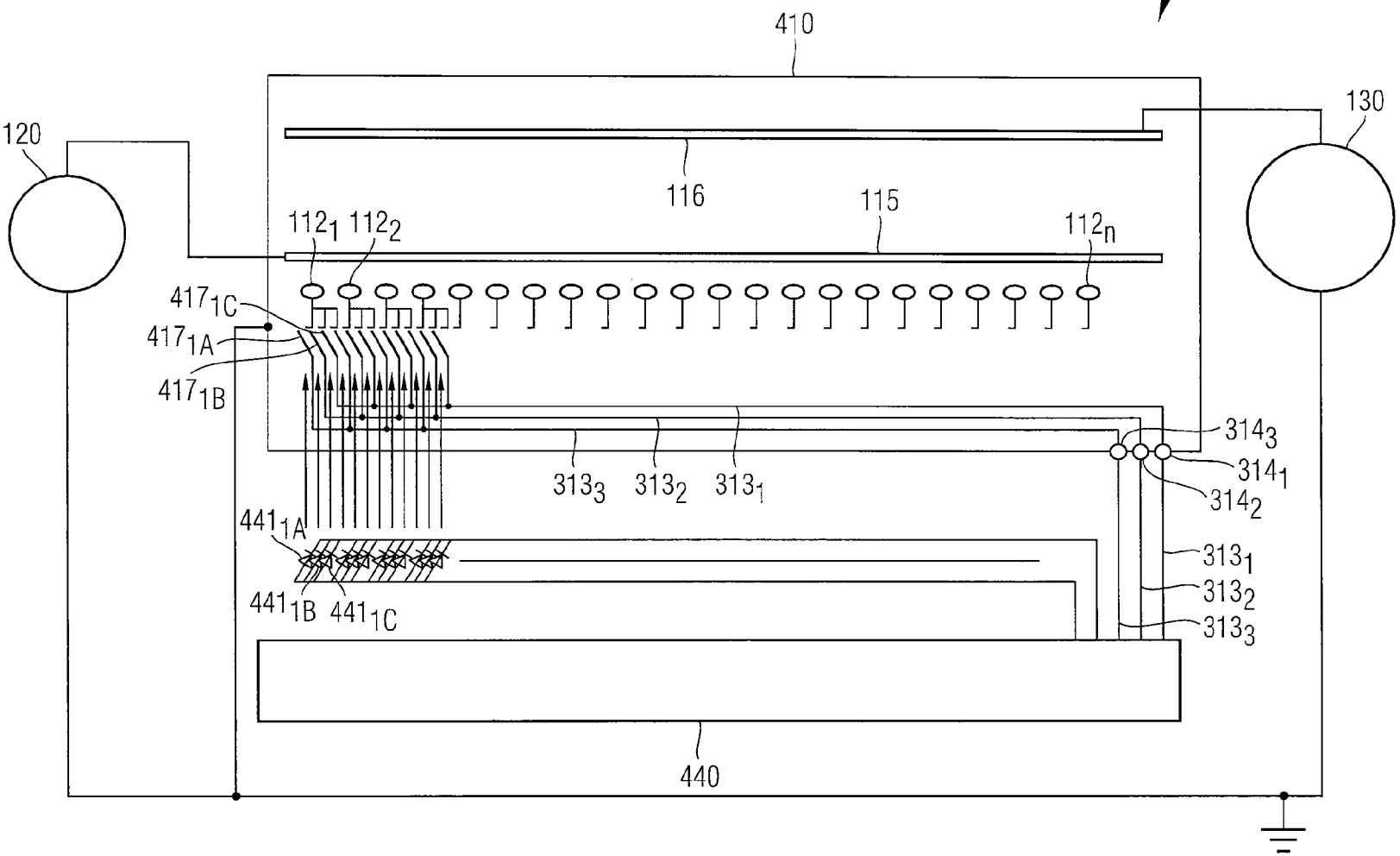
FIG. 4 is a schematic view of one embodiment of an x-ray tube.

As shown in FIG. 4, in one embodiment, provision may be made for selectively connecting each of the plurality of cathode voltage supplies 313 of an x-ray tube 410 to the cathodes 112 using several switching elements 417. For example, in three cathode voltage supplies 313, three switching elements $\mathbf{417}_{1A} \ldots \mathbf{417}_{1C}$ are assigned to each cathode $\mathbf{112}_1$ and activated by three wireless transmitter elements $\mathbf{441}_{1A} \ldots \mathbf{441}_{1C}$. This more costly arrangement in comparison with the embodiments shown in FIGS. 2 and 3 offers the greater flexibility. If the cathode voltage supply (supplies) is/are designed for the supply of one cathode, the embodiment of FIG. 2 allows the operation of a single cathode at a desired time. The embodiment of FIG. 3 allows the simultaneous operation of one cathode in each case out of the group of cathodes. The embodiment shown in FIG. 4 allows the simultaneous operation of any three given cathodes. The control unit 440 may selectively activate the cathode voltage supplies 313 in addition to activating the transmitter element 441.

In one embodiment, provision may be made for activation of the cathodes (e.g., spatially randomly arranged) by a matrix. For example, the cathode voltage supplies may form the rows, and the wireless transmitter elements may form the columns of the matrix. If, for example, eight cathodes are available, the eight cathodes may be arranged in a 2×4 matrix: two cathode voltage supplies supply two groups of cathodes, each of the groups including four cathodes. Each cathode is assigned to one switching element. Four wireless transmitter elements each supply one switching element from each of the two groups. In one embodiment, the control unit controls both the wireless transmitter elements and the cathode voltage supplies. By selection of one of the cathode voltage supplies (e.g., the row) and selection of one of the wireless transmitter elements (e.g., the column), selection of one cathode is possible. The cathode may be connected to the cathode voltage supply via the switching element assigned thereto. In one embodiment, the number of wireless transmitter elements and cathode voltage supplies may be optimized. FIG. 2, for example, shows a 1×n matrix: one cathode voltage supply and n wireless transmitter elements.

The present embodiments explained in detail above are particularly suitable in connection with the CNT cathodes described in the introduction but may also be used with any other cathodes, including conventional hot cathodes. Thermal screening or cooling of the switching elements may be necessary.

In the present embodiments with regard to the wirelessly activatable elements 217, 417, reference is made primarily to switching elements (e.g., on/off switches), which make or break the electrically conductive connections of the cathodes 112 or groups of cathodes to the cathode control voltage line 213 or the cathode voltage lines $\mathbf{313}_1 \ldots \mathbf{313}_3$ in response to the control signals. In one embodiment, control of the cathode current may, for example, take place using modulated control signals, such as pulse width modulation (PWM) or pulse frequency modulation (PFM). Time and/or frequency division multiplexing (FDM) may also be used to reduce the number of wireless transmitter elements.

In one embodiment, the wireless transmitter elements and the wirelessly activatable elements may be configured such that the control signals influence the resistance of the electrically conducting connections of the cathodes or groups of cathodes to the cathode control voltage line(s) and thus control the intensity of the current flowing through the electrically conductive connections. For example, if light controllable semiconductors are used as the wirelessly activatable elements, the intensity and/or the wavelength of the light sent out by the wireless transmitter elements are used for the control of the current flowing through the wirelessly activatable elements.

The control units 240, 340, 440 may include a learn mode and/or a calibration mode. In the learn mode, the current flowing in the cathode control voltage line(s) (e.g., cathode current) is measured while the activation of the wirelessly activatable element is varied. For each activation, the measured value of the cathode current is stored so that a table (e.g., overall or individually for each cathode) exists in the control unit, which represents the correlation between activation and cathode current. In the calibration mode, the current flowing in the cathode control voltage line(s) is also measured, and the activation of the wirelessly activatable element is varied until a determined current measurement value is obtained. If the determined current measurement value is achieved, then a corresponding activation is stored (e.g., separately for each cathode). The learn mode and the calibration mode have similarities and may be combined in any way. The calibration mode is useful if few (e.g., between 1 and 5) discrete cathode current strengths, which are to be kept to accurately, are desired in the practical application. The learn mode may be used if a link between the activation current and the cathode current is to be determined initially (e.g., different for each cathode due to a large series dispersion), and in practical application, many different values are desired for the cathode current strengths.

Although the present embodiments are presented with reference to optical transmission procedures between the wireless transmitter element and the wirelessly activatable element, other wireless transmission procedures may also be used in additional embodiments of the invention. For example, a magnetic coupling is possible using pulse transformers, of which one winding is arranged in the region under vacuum, and another winding is arranged outside of the region under vacuum. A magnetic coupling is also possible using elements that use the giant magnetoresistance (GMR) effect or also using Hall elements. Couplings using electric fields are also possible.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An x-ray tube comprising:

a region under vacuum;

several cathodes arranged in the region under vacuum; and several wirelessly activatable elements arranged in the region under vacuum, wherein the several wirelessly activatable elements are each assigned to a cathode or a group of cathodes and make an electrically conducting connection of the cathode or the group of cathodes to a cathode control voltage line when a control signal from outside of the region under vacuum is received.

2. The x-ray tube as claimed in claim 1, wherein the activation of the several wirelessly activatable elements takes place optically.

3. The x-ray tube as claimed in claim 2, wherein the several wirelessly activatable elements are light-controllable semiconductors.

4. The x-ray tube as claimed in claim 1, wherein the activation of the several wirelessly activatable elements takes place using an electric field, magnetic field or both electric and magnetic fields.

5. The x-ray tube as claimed in claim 4, wherein the several wirelessly activatable elements are receivers of pulse transformers using GMR effect or Hall elements.

6. The x-ray tube as claimed in claim 1, comprising several cathode control voltage lines.

7. A system comprising:

an x-ray tube;

several transmitter elements for wireless activation of several wirelessly activatable elements in a vacuum region; and a control unit for controlling the several transmitter elements.

8. The system as claimed in claim 7, wherein the several wirelessly activatable elements make or break the electrically conductive connections of cathodes or groups of cathodes to a cathode control voltage line in response to control signals from the several transmitter elements.

9. The system as claimed in claim 8, wherein the control signals are modulated in order to control the intensity of current flowing through the electrically conductive connections.

10. The system as claimed in claim 7, wherein the several transmitter elements and the several wirelessly activatable elements are configured such that control signals influence resistances of electrically conductive connections of cathodes or groups of cathodes to a cathode control voltage line and thus control an intensity of current flowing through the electrically conductive connections.

11. The system as claimed in claim 7, comprising a device for measuring an electrical current flowing through a cathode control voltage line, and the control unit including a calibration mode, in which:

a defined control signal is emitted;

an assigned cathode current measurement value is detected;

the defined control signal is modified until a defined cathode current measurement value is achieved;

the modified control signal is stored for the defined cathode current measurement value, and the process is repeated until corresponding control signals are determined for all cathode current measurement values.

12. The system as claimed in claim 7, comprising a measurement device for measuring electrical current flowing through a cathode control voltage line, and the control unit including a learn mode, in which:

a defined control signal is emitted;

an assigned cathode current measurement value is detected; and an assignment of the defined control signal to the assigned cathode current measurement value is stored.

13. The x-ray tube as claimed in claim 2, comprising several cathode control voltage lines.

14. The x-ray tube as claimed in claim 3, comprising several cathode control voltage lines.

15. The x-ray tube as claimed in claim 4, comprising several cathode control voltage lines.

16. The x-ray tube as claimed in claim 5, comprising several cathode control voltage lines.

17. The system as claimed in claim 8, comprising a device for measuring an electrical current flowing through a cathode control voltage line, and the control unit including a calibration mode, in which:

a defined control signal is emitted;

an assigned cathode current measurement value is detected;

the defined control signal is modified until a defined cathode current measurement value is achieved;

the modified control signal is stored for the defined cathode current measurement value, and the process is repeated until corresponding control signals are determined for all cathode current measurement values.

18. The system as claimed in claim 9, comprising a device for measuring an electrical current flowing through a cathode control voltage line, and the control unit including a calibration mode, in which:

a defined control signal is emitted;

an assigned cathode current measurement value is detected;

the defined control signal is modified until a defined cathode current measurement value is achieved;

the modified control signal is stored for the defined cathode current measurement value, and the process is repeated until corresponding control signals are determined for all cathode current measurement values.

19. The system as claimed in claim 8, comprising a measurement device for measuring electrical current flowing through a cathode control voltage line, and the control unit including a learn mode, in which:

a defined control signal is emitted;

an assigned cathode current measurement value is detected; and an assignment of the defined control signal to the assigned cathode current measurement value is stored.

20. The system as claimed in claim 10, comprising a measurement device for measuring electrical current flowing through a cathode control voltage line, and the control unit including a learn mode, in which:

a defined control signal is emitted;

an assigned cathode current measurement value is detected; and an assignment of the defined control signal to the assigned cathode current measurement value is stored.

* * * * *